US006821943B2

(12) United States Patent
Avery et al.

(10) Patent No.: US 6,821,943 B2
(45) Date of Patent: Nov. 23, 2004

(54) HARD SURFACE ANTIMICROBIAL CLEANER WITH RESIDUAL ANTIMICROBIAL EFFECT COMPRISING AN ORGANOSILANE

(75) Inventors: Richard W. Avery, High Wycombe (GB); Shannon L. Bakich, Racine, WI (US); Roberta A. Wick, Racine, WI (US); Harry E. Bryant, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 307 days.

(21) Appl. No.: 10/095,933

(22) Filed: Mar. 12, 2002

(65) Prior Publication Data

US 2003/0073600 A1 Apr. 17, 2003

Related U.S. Application Data

(60) Provisional application No. 60/275,405, filed on Mar. 13, 2001.

(51) Int. Cl.[7] ..... C11D 3/48; C11D 9/36

(52) U.S. Cl. ..... 510/466; 510/413; 510/421; 510/382; 510/384; 510/388; 510/362; 510/238

(58) Field of Search ..... 510/466, 413, 510/421, 382, 384, 388, 362, 238

(56) References Cited

U.S. PATENT DOCUMENTS

| | | | | | |
|---|---|---|---|---|---|
| 3,172,899 | A | | 3/1965 | Bailey | |
| 3,671,630 | A | | 6/1972 | Carroll et al. | 424/174 |
| 4,529,749 | A | | 7/1985 | Favre et al. | |
| 5,118,651 | A | | 6/1992 | Gubelmann et al. | |
| 5,342,534 | A | * | 8/1994 | Skrobala et al. | 15/104.93 |
| 5,380,741 | A | | 1/1995 | Hutt et al. | |
| 5,387,372 | A | * | 2/1995 | Su | 510/159 |
| 5,411,585 | A | | 5/1995 | Avery et al. | |
| 5,444,094 | A | | 8/1995 | Malik et al. | |
| 5,539,086 | A | | 7/1996 | Farb et al. | |
| 5,554,656 | A | | 9/1996 | Lower et al. | |
| 5,626,968 | A | | 5/1997 | Priou | |
| 5,629,006 | A | * | 5/1997 | Hoang et al. | 424/405 |
| 5,866,261 | A | | 2/1999 | Kerr, III et al. | |
| 5,908,854 | A | | 6/1999 | McCue et al. | |
| 5,951,993 | A | * | 9/1999 | Scholz et al. | 424/405 |
| 6,004,545 | A | * | 12/1999 | Karlen et al. | 424/70.12 |
| 6,039,965 | A | | 3/2000 | Donlan et al. | |
| 6,087,319 | A | | 7/2000 | Norman | |
| 6,090,765 | A | * | 7/2000 | Black et al. | 510/238 |
| 6,117,440 | A | * | 9/2000 | Suh et al. | 424/407 |
| 6,159,916 | A | * | 12/2000 | Robbins et al. | 510/238 |
| 6,294,186 | B1 | * | 9/2001 | Beerse et al. | 424/405 |
| 6,337,383 | B1 | | 1/2002 | West et al. | |

FOREIGN PATENT DOCUMENTS

| | | | | |
|---|---|---|---|---|
| EP | 356354 | B1 | | 2/1990 |
| EP | 493186 | A2 | | 7/1992 |
| EP | 337835 | B1 | | 6/1993 |
| EP | 1010727 | A2 | | 6/2000 |
| FR | 2771416 | | * | 5/1999 |
| FR | 2771416 | A | | 5/1999 |
| WO | WO 93/00107 | A1 | | 1/1993 |
| WO | WO 98/00216 | A1 | | 1/1998 |
| WO | WO 98/49104 | A1 | | 11/1998 |
| WO | WO 99/18784 | A1 | | 4/1999 |
| WO | WO 99/27031 | A1 | | 6/1999 |
| WO | WO 99/35181 | A1 | | 7/1999 |
| WO | WO 00/12662 | A1 | | 3/2000 |
| WO | WO 00/71240 | A1 | | 11/2000 |
| WO | WO 00/71241 | A1 | | 11/2000 |
| WO | WO 00/71591 | A1 | | 11/2000 |
| WO | WO 00/71651 | A2 | | 11/2000 |
| WO | WO 00/71659 | A1 | | 11/2000 |
| WO | WO 00/71660 | A1 | | 11/2000 |
| WO | WO 01/81635 | A1 | | 11/2001 |

OTHER PUBLICATIONS

English Translation of WO 99/18784.

* cited by examiner

*Primary Examiner*—Charles Boyer

(57) ABSTRACT

A hard surface antimicrobial cleaner is disclosed. The hard surface antimicrobial cleaner includes a disinfectant and a polysiloxane with at least one poly(oxyalkylene) side chain wherein the cleaner kills bacteria on a hard surface for at least 24 hours after being sprayed onto and wiped from the hard surface. The hard surface antimicrobial cleaner may include a solvent, a sequesterant, a surfactant, or a water soluble organosilane. Another version of the cleaner also includes a disinfectant and a polysiloxane with at least one poly(oxyalkylene) side chain and inhibits biofilm formation on a hard surface for at least 24 hours after being sprayed onto the hard surface.

22 Claims, No Drawings

HARD SURFACE ANTIMICROBIAL CLEANER WITH RESIDUAL ANTIMICROBIAL EFFECT COMPRISING AN ORGANOSILANE

CROSS-REFERENCES TO RELATED APPLICATIONS

This application claims the benefit of U.S. Provisional Patent Application No. 60/275,405 filed Mar. 13, 2001.

STATEMENT REGARDING FEDERALLY SPONSORED RESEARCH

Not Applicable.

BACKGROUND OF THE INVENTION

1. Field of the Invention

This invention relates to a hard surface antimicrobial cleaner with a residual antimicrobial effect, and to hard surface antimicrobial cleaner that inhibits the formation of biofilm on the hard surface.

2. Description of the Related Art

It is well known that the washing of hard surfaces (e.g., glass, tile, porcelain, fiberglass composites, metallic surfaces, ceramic surfaces, laminate surfaces, hard polymeric surfaces) with antimicrobial cleaners can remove many bacteria from the washed surfaces. Removal of the bacteria may be due to surfactants or disinfectants in the cleaner and/or the mechanical action of the wash procedure. Antimicrobial hard surface cleaners have been marketed in a variety of forms for some time. Typically, these hard surface antimicrobial products have been formulated to provide bacteria removal during washing. However, there has been more interest recently in hard surface cleaners that have also been shown to provide a residual effectiveness against bacteria. By residual effectiveness it is meant that bacteria on a surface is killed for some period of time following the washing process. Given the potential severe health impacts of bacteria, there is a continuing search for improved antimicrobial cleaners which provide residual effectiveness versus bacteria.

Hard surfaces may also be prone to the attachment of biofilm, which also may have health impacts. A biofilm consists of cells immobilized on a surface and embedded in an organic polymer matrix of microbial origin. A biofilm is a surface accumulation, which is not necessarily uniform in time or space. A biofilm may be composed of a significant fraction of inorganic or abiotic substances held cohesively by the biotic matrix. A biofilm is a protective matrix for bacteria, with the essential purpose of survival in an environment of limited nutrient supply. Biofilms consist of both host microbes and their extracellular products, usually exopolysaccharides. Microbes have a tendency to form these protective exopolysaccharide matrices after they have adhered to a surface. The formation of biofilm complexes requires only humid conditions and/or water systems and contact with a support surface. With respect to nutrients, a nutrient deficiency in fact may increase the biofilm formation capacity of microbes.

Biofilms generally can be produced by almost all microbes under suitable conditions. The most common biofilm producers belong to the genera *Pseudomonas, Enterobacter, Flavobacterium, Alcaligenes, Staphylococcus, Klebsiella* and *Bacillus*. One of the main purposes of natural biofilm formation is for the protection of the host microbes from a hostile environment. As a consequence, there is a combative interaction between microbes in biofilms and biocides such as disinfectants. Further, the sessile mode of bacterial growth in biofilms differs from that of the same bacteria species that are present as planktonic cells in a circulating aqueous medium which interfaces with the biofilm. Because of the ramifications of biofilm formation, there have been proposed techniques to inhibit the growth of biofilm on a surface. For example, surfactants have been added to aqueous systems to inhibit microbial colonization on a surface (see, e.g., U.S. Pat. No. 6,039,965). However, there is a need for a hard surface antimicrobial cleaner that cleans and disinfects a hard surface and thereafter inhibits the formation of biofilm on the hard surface.

Thus, given the potential health impacts of bacteria and biofilm on a surface, particularly in kitchen areas, there is a need for hard surface antimicrobial cleaners which clean and disinfect a hard surface and also provide for residual effectiveness versus bacteria. Further, there is a need for hard surface antimicrobial cleaners which clean and disinfect a hard surface and thereafter inhibit the formation of biofilm on the hard surface.

BRIEF SUMMARY OF THE INVENTION

The foregoing needs are met by a hard surface antimicrobial cleaner according to the invention including a disinfectant and a polysiloxane with at least one poly (oxyalkylene) side chain wherein the cleaner kills bacteria on a hard surface for at least 24 hours after being sprayed onto and wiped from the hard surface. The polysiloxane has the formula:

$$R_1R_2R_3SiO(R_4R_5SiO)_p(R_6QSiO)_qSiR_3R_2R_1$$

in which $R_1$, $R_2$, $R_4$, $R_5$, $R_6$ are identical or different and are a $C_1$–$C_6$ alkyl or phenyl, $R_3$ is identical or different and is $C_1$–$C_6$ alkyl, phenyl or Q, and Q is an ether polyoxyalkylene group of the formula —R—O—$(R'O)_nR''$ where R is a linear or branched $C_3$–$C_{15}$ alkyl group, $(R'O)_n$ is a poly (ethyleneoxy) and/or poly(propyleneoxy) group, n is a mean value ranging from 5 to 200, R" is H or a $C_1$–$C_6$ alkyl group, p is a mean value ranging from 10 to 200, and q is 0 or a mean value ranging from 1 to 200, $R_3$ being Q when q is 0.

In a first version of the invention, the hard surface antimicrobial cleaner includes from about 0.01% to about 20% by weight of the total weight of the cleaner of the disinfectant; from about 0.01% to about 20% by weight of the total weight of the cleaner of the polysiloxane with at least one poly(oxyalkylene) side chain; and from about 0.5% to about 20% by weight of the total weight of the cleaner of a solvent.

In a second version of the invention, the hard surface antimicrobial cleaner includes from about 0.01% to about 20% by weight of the total weight of the cleaner of the disinfectant; from about 0.01% to about 20% by weight of the total weight of the cleaner of the polysiloxane with at least one poly(oxyalkylene) side chain; and from 0.1 to about 20% by weight of the total weight of the cleaner of a sequesterant.

In a third version of the invention, the hard surface antimicrobial cleaner includes from about 0.01% to about 20% by weight of the total weight of the cleaner of the disinfectant; from about 0.01% to about 20% by weight of the total weight of the cleaner of the polysiloxane with at least one poly(oxyalkylene) side chain; and from 0.5 to about 20% by weight of the total weight of the cleaner of a surfactant selected from nonionic surfactants, amphoteric surfactants, sarcosine anionic surfactants, cationic surfactants and mixtures thereof.

In a fourth version of the invention, the hard surface antimicrobial cleaner includes from about 0.01% to about 20% by weight of the total weight of the cleaner of the disinfectant; from about 0.01% to about 20% by weight of the total weight of the cleaner of the polysiloxane with at least one poly(oxyalkylene) side chain; and an organosilane of the formula: $A_{3-x}B_xSiD$ wherein A is —OH or a hydrolyzable group, B is an alkyl group of from 1 to 4 carbon atoms, x has a value of 0, 1 or 2, and D is a hydrocarbon group of from 1 to 4 carbon atoms, phenyl, or a nonionic or cationic, substituted-hydrocarbon group containing at least one oxygen or nitrogen group or salts of such substituted-hydrocarbon groups.

In a fifth version of the invention, the hard surface antimicrobial cleaner includes from about 50% to about 99.9% by weight of the total weight of the cleaner of an alkyl alcohol disinfectant; and the polysiloxane with at least one poly(oxyalkylene) side chain, wherein the cleaner inhibits biofilm formation on a hard surface for at least 24 hours after being sprayed onto the hard surface. In the fifth version of the invention, the alkyl alcohol disinfectant is preferably ethanol, n-propanol or isopropanol, and serves to disinfect the hard surface and to distribute the polysiloxane on the hard surface in order to inhibit biofilm formation on the hard surface. All or most of the alkyl alcohol disinfectant may eventually evaporate from the hard surface due to the volatility of the alcohol. The fifth version of the invention may consist essentially of the alkyl alcohol disinfectant, the polysiloxane and water, if desired. Alternatively, the fifth version of the invention may include a solvent, a sequesterant, a surfactant or an organosilane.

It is therefore an advantage of the present invention to provide a hard surface antimicrobial cleaner that may be used to clean and disinfect a hard surface and also provides for residual effectiveness versus bacteria.

It is another advantage of the present invention to provide a hard surface antimicrobial cleaner that may be used to clean and disinfect a hard surface and thereafter inhibits the formation of biofilm on the hard surface.

These and other features, aspects, and advantages of the present invention will become better understood upon consideration of the following detailed description and appended claims.

DETAILED DESCRIPTION

An antimicrobial cleaner according to the invention will be useful for all hard surface cleaning and disinfectant formulations, including kitchen cleaners and disinfectants, bathroom cleaners and disinfectants, all-purpose cleaners and disinfectants, toilet cleaners and disinfectants (both periodic and continuous), bowl cleaners and disinfectants, and drain cleaners and disinfectants. An antimicrobial cleaner according to the invention is particularly suitable as a fully diluted hard surface cleaner. As such, it can be used without further dilution by applying it at full strength to a soiled hard surface, and wiping and/or scrubbing to remove the soil.

The cleaner is especially useful for cleaning kitchen surfaces which are soiled. For instance, when certain embodiments of the invention are used as a kitchen cleaner and disinfectant, the cleaner would have the advantage of killing bacteria for at least 24 hours after application (i.e., the cleaner provides a residual effectiveness against bacteria). Of course, upon spillage of containment such as gravy on a cleaned kitchen surface, one would re-use the cleaner.

When certain other embodiments of the invention are used as a hard surface cleaner and disinfectant, the cleaner would have the advantage of inhibiting the formation of biofilm on the hard surface for at least 24 hours after application. In other words, the cleaner provides a residual inhibition of the formation of biofilm. By residual inhibition, it is meant that biofilm does not form on the surface for some period of time following the application process.

A hard surface antimicrobial cleaner according to the invention includes from about 0.01% to about 99% by weight of the total weight of the cleaner of a disinfectant (as 100% active). Suitable disinfectants include, for example, quaternary ammonium compounds, phenolics (aromatic alcohols), guanide derivatives, ampholytes (betaines), aldehydes (such as glutaraldehyde and formaldehyde), and alkyl alcohols. A disinfectant can be understood to be a hygiene agent which shows a reduction in the number of viable microorganisms in a specified culture when used at a specified level. In one embodiment of the hard surface antimicrobial cleaner, the disinfectant is other than an alkyl alcohol, and the cleaner preferably includes from about 0.01% to about 20% by weight of the total weight of the cleaner of the disinfectant, and most preferably from about 0.1% to about 2% by weight of the total weight of the cleaner of the disinfectant. In another embodiment of the hard surface antimicrobial cleaner, the disinfectant is a volatile alkyl alcohol such as ethanol or propanol, and the cleaner preferably includes from about 50% to about 99.9% by weight of the total weight of the cleaner of the alkyl alcohol, and most preferably from about 60% to about 80% by weight of the total weight of the cleaner of the alkyl alcohol.

Non-limiting illustrative disinfectant quaternary ammonium compounds include benzalkonium chloride, alkyl-dimethyl-benzylammonium chloride, alkyl-dimethyl-ethylbenzylammonium chloride, dodecyl-dimethyl-3,4-dichlorobenzylammonium chloride, dodecyl-di-(2-hydroxyethyl)-benzylammonium chloride, 4-diisobutyl-phenoxyethoxyethyl-dimethylbenzylammonium chloride, 4-diisobutyl-cresoxyethoxyethyl-dimethylbenzylammonium chloride, dimethyl-didecylammonium chloride, cetyl-trimethylammonium bromide, dodecyl-pyridinium chloride, cetyl pyridinium chloride, dodecyl-isoquinolinium chloride, decamethylene-bis-4-aminoquinaldinium dichloride, and mixtures thereof. One example quaternary ammonium compound is BTC 2125M, an alkyldimethylbenzyl ammonium chloride and dimethyl ethylbenzyl ammonium chloride mixture commercially available from Stepan.

Non-limiting illustrative disinfectant phenolics include phenol, mono- and poly-chlorophenols, cresols, 4-chloro-3-methylphenol, 3,5-dimethyl-4-chlorophenol, thymol, 4-chlorothymol, 4-t-amylphenol, saligenin, 4-n-hexylresorcinol, carvacrol, 2-phenylphenol, 2-benzyl-4-chlorophenol,2,2'-dihydroxy-5,5'-dichlorodiphenylmethane, 2,2'-dihydroxy-3,3',5,5',6,6'-hexachlorodiphenylmethane, 2,2'-dihydroxy-5,5'-dichlorodiphenyl sulphide, 2,2'-dihydroxy-3,3',5,5'-tetrachlorodiphenyl sulphide, 2-hydroxy-2',4,4'-trichlorodiphenyl ether, dibromosalicyl and mixtures thereof.

Non-limiting illustrative disinfectant guanide compounds include compounds of the general formula (I), (II) or (III) given below:

(I)

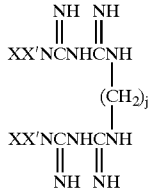

-continued (II)

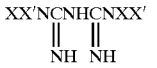

(III)

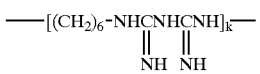

In the formulas (I), (II) and (III), X is an alkyl group, an aminoalkyl group, a phenyl group, an alkylphenyl group, a halophenyl group, a hydroxyphenyl group, a methoxyphenyl group, a carboxyphenyl group, a naphthyl group or a nitrile group; X' is a hydrogen atom or an alkyl group; and j and k each is a positive integer, preferably an integer within the range of 2 to 10. A preferred example of a suitable guanide compound is chlorhexidine, also known as 1,6-bi($N^5$-p-chlorophenyl-$N^1$-biguanido)hexane.

Non-limiting illustrative disinfectant alkyl alcohols include ethanol, n-propanol, isopropanol and mixtures thereof.

A hard surface antimicrobial cleaner according to the invention includes from about 0.01% to about 20% by weight of the total weight of the cleaner of a polysiloxane with at least one poly(oxyalkylene) side chain. Preferably, the polysiloxane has the formula: $R_1R_2R_3SiO(R_4R_5SiO)_p(R_6QSiO)_qSiR_3R_2R_1$ in which $R_1$, $R_2$, $R_4$, $R_5$, $R_6$ are identical or different and are a $C_1$–$C_6$ alkyl or phenyl, $R_3$ is identical or different and is $C_1$–$C_6$ alkyl, phenyl or Q, and Q is an ether polyoxyalkylene group of the formula —R—O—$(R'O)_nR''$ where R is a linear or branched $C_3$–$C_{15}$ alkyl group, $(R'O)_n$ is a poly(ethyleneoxy) and/or poly (propyleneoxy) group, n is a mean value ranging from 5 to 200, R" is H or a $C_1$–$C_6$ alkyl group, p is a mean value ranging from 10 to 200, and q is 0 or a mean value ranging from 1 to 200, $R_3$ being Q when q is 0. These polymers are shown in PCT International Publication WO 99/18784 which is incorporated herein by reference. One preferred polysiloxane will be referred to as "S2" and has the formula:

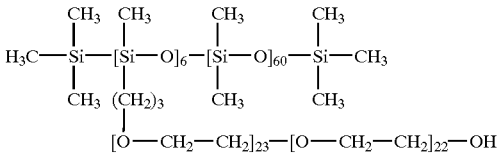

Polysiloxanes with one or more poly(oxyalkylene) side chains can be made by processes described in U.S. Pat. Nos. 6,337,383 and 3,172,899 which are incorporated herein by reference. A hard surface antimicrobial cleaner according to the invention preferably includes from about 0.01% to about 5% by weight of the total weight of the cleaner of the polysiloxane. A hard surface antimicrobial cleaner according to the invention most preferably includes from about 0.025% to about 1% by weight of the total weight of the cleaner of the polysiloxane (as 100% active).

A hard surface antimicrobial cleaner according to the invention may optionally include from 0 to about 20% by weight of the total weight of the cleaner of a surfactant (as 100% active) which can be a nonionic surfactant, an amphoteric surfactant, a sarcosine anionic surfactant, a cationic surfactant or mixtures thereof. Preferably, the surfactant is used in an amount of 0.5% to 10% by weight of the total weight of the cleaner. More preferably, the surfactant is used in an amount of 1% to 2% by weight of the total weight of the cleaner. The term "amphoteric" surfactant includes "zwitterionic" surfactants for the purposes of this invention since those terms are often used almost interchangeably. These surfactants are well known and a large number are commercially available as can be seen from an examination of the widely available "McCutcheon's Emulsifiers & Detergents" and the "CTFA Cosmetic Ingredient Dictionary".

Examples of nonionic surfactants include alcohol ethoxylates such as $C_8$ to $C_{18}$ alcohol ethoxylates containing from about 3 to 50 moles of ethylene oxide per molecule; $C_8$ to $C_{18}$ fatty acid esters and amides containing from about 2 to 50 moles of ethylene oxide; $C_8$ to $C_{18}$ fatty alcohols; $C_8$ to $C_{18}$ diols such as tetramethyl decynediol and dimethyl octynediol; block copolymers of polyethylene oxide and polypropylene oxide; $C_8$ to $C_{18}$ fatty acid esters of glycerine; ethoxylated and propoxylated $C_8$ to $C_{18}$ fatty alcohols; $C_8$ to $C_{18}$ fatty amine and amidoamine oxides; $C_8$ to $C_{18}$ fatty amides and alkanolamides; and alkyl saccharides (e.g., alkyl glucosides) or alkenyl-saccharides such as a saccharide having the formula: $R_{10}$—O—$(R_{12}O)_t$—$(G)_p$ where $R_{10}$ is a linear or branched alkyl, alkenyl or alkyl-phenyl group having 6–18 carbon atoms, $R_{12}$ is an alkylene group having 2–4 carbon atoms, G is a reduced saccharide residue having 5–6 carbon atoms, t is 0–10, and p is 1–10.

Examples of amphoteric surfactants include amine oxides, $C_8$ to $C_{18}$ sultaines such as coco-sultaine and cocamidopropyl hydroxysultaine; $C_8$ to $C_{18}$ fatty derivatives of amino acids such as cocamphocarboxyglycinate and lauramphoglycinate; $C_8$ to $C_{18}$ alkyl betaines such as decyl betaine, coco-betaine, lauryl betaine, myristyl betaine and stearyl betaine; and $C_8$ to $C_{18}$ amidoalkyl betaines such as cocoamidoethyl betaine, cocamidopropyl betaine, lauramidopropyl betaine, myristamidopropyl betaine and oleamidopropyl betaine.

Since sarcosine surfactants are known to be compatible with quaternary ammonium compounds, this class of anionic surfactants can be used with quaternary ammonium compounds. Examples of such surfactants are $C_8$ to $C_{18}$ alkyl sarcosines and their alkali metal or ammonium salts such as sodium, potassium, lithium or ammonium $C_8$ to $C_{18}$ alkyl sarcosinates.

Examples of cationic surfactants other than the quaternary ammonium compounds already described above are quaternary ammonium compounds which contain at least two nitrogen-bonded alkyl chains having at least about 16 carbon atoms such as distearyldimonium chloride and ditallowdimonium chloride; $C_8$ to $C_{18}$ fatty alkyl amines, amidoalkylamines and amidoalkanolamines, and their salts; ethoxylated amines; amine oxides; and immidazoline.

A hard surface antimicrobial cleaner according to the invention may optionally include from 0 to about 20% by weight of the total weight of the cleaner of a sequesterant (as 100% active) such as ethylenediamine tetraacetic acid (EDTA) or its salts (e.g. EDTA, sodium salt), phosphonates, nitrilotriacetic acid (NTA) or its salts, hydroxyethylene diamine and triacetic acid (HEDTA) or its salts, and diethylene triamine pentaacetic acid (DTPA) or its salts. Preferably, the sequesterant is used in an amount of 0.1% to 15% by weight of the total weight of the cleaner. More preferably, the sequesterant is used in an amount of 0.05% to 5% by weight of the total weight of the cleaner.

A hard surface antimicrobial cleaner according to the invention may optionally include from 0 to about 20% by weight of the total weight of the cleaner of a solvent (as 100% active) such as alcohols, glycols, ethers and glycol ethers, such as diethylene glycol monobutyl ether ("Butyl Carbitol"), dipropylene glycol n-butyl ether ("DPnB"), propylene glycol n butyl ether ("PnB"), ethylene glycol butyl ether ("Butyl Cellosolve"), dipropylene glycol monomethylether, propylene glycol, carbitol, methoxypropanol, glycerine, isopropanol and ethanol. Preferably, the solvent is used in an amount of 0.5% to 10% by weight of the total weight of the cleaner. Most preferably, the solvent is used in an amount of 0.5% to 3% by weight of the total weight of the cleaner.

A hard surface antimicrobial cleaner according to the invention may optionally include from 0 to about 5% by weight of the total weight of the cleaner of an organosilane of the formula: $A_{3-x}B_xSiD$ wherein A is —OH or a hydrolyzable group, B is an alkyl group of from 1 to 4 carbon atoms, x has a value of 0, 1 or 2, and D is a hydrocarbon group of from 1 to 4 carbon atoms, phenyl, or a nonionic or cationic, substituted-hydrocarbon group containing at least one oxygen or nitrogen group or salts of such substituted-hydrocarbon groups. These organosilanes and methods for stabilizing these organosilanes are described in U.S. Pat. Nos. 6,087,319 and 5,411,585 which are incorporated herein by reference. Preferably, A is selected from the group consisting of $—OR^1$ and $—OR^{2A}OR^1$ where each $R^1$ is $R^2$ or hydrogen, $R^2$ is an alkyl group of 1 to 4 carbon atoms, $R^{2A}$ is a divalent saturated hydrocarbon group of from 1 to 4 carbon atoms, x has a value of 0 or 1, and D is selected from the group consisting of alkyl groups of from 1 to 4 carbon atoms, vinyl, allyl, glycidoxypropyl, $—R^3N(R^4)_yH_{2-y}$, $—R^3N^{(+)}(R^4)_yH_{3-y}X^{(-)}$, $—R^3NHR^3N(R^4)_yH_{2-y}$, $—R^3NHR^3N^{(+)}(R^4)_yH_{3-y}X^{(-)}$, $—R^3N^{(+)}R^2R^4R^5X^{(-)}$ wherein $R^3$ is a divalent saturated hydrocarbon group of from 1 to 12 carbon atoms; $R^4$ and $R^5$ are each selected from the group consisting of alkyl groups of 1 to 18 carbon atoms, $—CH_2C_6H_5$, $—CH_2CH_2OH$ and $—CH_2OH$; y has a value of 0, 1 or 2; and X is an anion. Most preferably, the organosilane is 3-trimethoxysilyl)propyldimethyloctadecyl ammonium chloride (commercially available as Dow Corning 5772) or 3-trimethoxysilyl)propylmethyldi(decyl)ammonium chloride. Preferably, a hard surface antimicrobial cleaner according to the invention includes from 0.01 to about 3% by weight of the total weight of the cleaner of any of the above organosilanes. The organosilane can further enhance the residual effectiveness against bacteria.

Optionally, other additives such as pH adjusters, buffers, detergent builders, acids, dyes, fragrance, viscosity adjusters, and corrosion inhibitors can be included in the hard surface antimicrobial cleaner of the present invention provided that they are compatible with the other ingredients. The hard surface antimicrobial cleaner of the present invention is typically formulated as an aqueous solution; however, water is not required in the cleaner. For example, the cleaner can be supplied as a concentrate, or water can be left out of the cleaner in favor of an alternative solvent such as an alkyl alcohol. A non-concentrated formula would be as described above.

EXAMPLES

The following examples serve to further illustrate the invention. The examples are not intended to limit the invention in any way.

Example 1

A formulation using the ingredients of Table 1 was prepared.

TABLE 1

| Chemical Description | Wt. % | Functional Description | Predicted Function within the formulation |
|---|---|---|---|
| Deionized Water | 96.350 | | |
| EDTA tetra sodium salt (40%) | 0.400 | sequesterant | boosts cleaning by removing calcium soils and deposits |

TABLE 1-continued

| Chemical Description | Wt. % | Functional Description | Predicted Function within the formulation |
|---|---|---|---|
| Ninox DO40 $C_{10}$ dimethyl amine oxide 40% | 0.563 | surfactant | emulsifies soils |
| Tergitol 15-S-7 (alcohol ethoxylate) | 0.300 | surfactant | emulsifies soils |
| Glucopon 425N (Alkyl Glucoside) | 0.563 | surfactant | emulsifies soils |
| Catigene 4513-80% Europe or BTC 2125 M (80%) US quaternary ammonium disinfectant | 0.413 | disinfectant | kills microbes |
| Butyl Cellosolve (ethylene glycol monobutyl ether) | 0.751 | solvent | removes soiling |
| Polymer S2 | 0.050 | disinfectant enhancer | retains disinfectant on treated surfaces |
| Sodium Hydroxide (30%) | 0.360 | alkali | pH balance |
| Fragrance IFF 4640 HBD (Lemon) | 0.250 | fragrance | fragrance |

Example 2

A formulation using the ingredients of Table 2 was prepared.

TABLE 2

| Chemical Description | Wt. % | Functional Description | Predicted Function within the formulation |
|---|---|---|---|
| Deionized Water | 96.450 | | |
| EDTA tetra sodium salt (40%) | 0.400 | sequesterant | boosts cleaning by removing calcium soils and deposits |
| Ninox DO40 $C_{10}$ dimethyl amine oxide 40% | 0.563 | surfactant | emulsifies soils |
| Tergitol 15-S-7 (alcohol ethoxylate) | 0.300 | surfactant | emulsifies soils |
| Glucopon 425N (Alkyl Glucoside) | 0.563 | surfactant | emulsifies soils |
| Catigene 4513-80% Europe or BTC 2125 M 80% US quaternary ammonium disinfectant | 0.413 | disinfectant | kills microbes |
| Butyl Cellosolve (ethylene glycol monobutyl ether) | 0.751 | solvent | Removes soiling |
| Polymer S2 | 0.050 | disinfectant enhancer | retains disinfectant on treated surfaces |
| Sodium Hydroxide (30%) | 0.360 | alkali | pH balance |
| Fragrance Takasago RM-1489 | 0.150 | fragrance | fragrance |

Example 3

A formulation using the ingredients of Table 3 was prepared.

TABLE 3

| Chemical Description | Wt. % | Functional Description | Predicted Function within the formulation |
|---|---|---|---|
| Deionized Water | 95.437 | | |
| EDTA tetra sodium salt (40%) | 0.400 | sequesterant | boosts cleaning by removing calcium soils and deposits |
| Ninox DO 40 (C10 dimethyl amine oxide) (40%) | 0.750 | surfactant | emulsifies soils |

TABLE 3-continued

| Chemical Description | Wt. % | Functional Description | Predicted Function within the formulation |
|---|---|---|---|
| Tergitol 15-S-7 (alcohol ethoxylate) | 0.200 | surfactant | emulsifies soils |
| Glucopon 425N (Alkyl Glucoside) | 0.750 | surfactant | emulsifies soils |
| Catigene 4513-80% Europe or BTC 2125 M (80%) USA (quaternary ammonium disinfectant) | 0.550 | disinfectant | Kills microbes |
| Butyl Cellosolve (ethylene glycol mono-butyl ether) | 0.570 | solvent | removes soiling |
| Hexyl Cellosolve (ethylene glycol n-hexyl ether) | 0.430 | solvent | removes soiling |
| Polymer S2 | 0.300 | disinfectant enhancer | retains disinfectant on treated surfaces |
| Sodium Hydroxide (30%) | 0.363 | Alkali | pH balance |
| Fragrance IFF 4640 HBD (Lemon) | 0.250 | fragrance | fragrance |

Example 4

The formulations of Examples 1 and 3 were tested against a competitive product with a claim of residual antimicrobial activity. To measure the residual antimicrobial benefit of the formulations of Examples 1 and 3, surfaces were treated with the formulation according to label directions. After 24 hours, under normal room conditions, surfaces were wiped and inoculated with appropriate test organisms. Residual activity was measured by log reduction of test organism compared to parallel controls.

The following results were obtained as shown in Table 4. Both Example 1 and Example 3 formulas were superior to the competitor product.

TABLE 4

Residual Antibacterial Results
Test Organism is *Staphylococcus aureus* (*Staph. Aureus*)
Test Surface is Glazed Ceramic Tile
Log reductions based on a comparison with log recovery of Controls.
Controls are Glazed Ceramic Tiles treated with 0.01% Triton X-100 surfactant

| Formula | Bacterial Log Reduction | Bacterial Log Reduction |
|---|---|---|
| Example 1 | 4.17 | |
| Example 3 | | 3.51 |
| Competitor Product with Residual Claim | 0.13 | 0.39 |
| Controls (Log recovery) | 6.64 | 6.93 |

Example 5

A formulation using the ingredients of Table 5 was prepared.

TABLE 5

| Chemical Description | Wt. % | Functional Description | Predicted Function within the formulation |
|---|---|---|---|
| Deionized Water | 96.305 | | |
| EDTA tetra sodium salt (40%) | 0.400 | sequesterant | boosts cleaning by removing calcium soils and deposits |

TABLE 5-continued

| Chemical Description | Wt. % | Functional Description | Predicted Function within the formulation |
|---|---|---|---|
| Ammonyx DO 40 C10 dimethyl amine oxide | 0.750 | surfactant | emulsifies soils |
| Tergitol 15-S-7 (alcohol ethoxylate) | 0.300 | surfactant | emulsifies soils |
| Glucopon 425N (Alkyl Glucoside) | 0.563 | surfactant | emulsifies soils |
| BTC 2125 M (quaternary ammonium disinfectant) | 0.413 | disinfectant | kills microbes |
| Butyl Cellosolve (ethylene glycol mono-butyl ether) | 0.751 | solvent | removes soiling |
| Polymer S2 | 0.050 | disinfectant enhancer | retains disinfectant on treated surfaces |
| Sodium Hydroxide (30%) | 0.218 | Alkali | pH balance |
| Fragrance IFF 4641 HBD | 0.250 | fragrance | Fragrance |

Example 5a

Using gravimetric analysis, the formulation of Example 5 was analyzed by measuring the percent removal of 25–29 milligrams of a lab generated, synthetic, greasy kitchen soil from enamel coated steel tiles with a Gardner Scrub Machine after 7 strokes. The percent removal was 94.4% soil removal.

Example 5b

The formulation of Example 5 was tested to measure the residual antimicrobial benefit of the formulation on surfaces treated with the formulation. After a test time, under normal room conditions, surfaces were wiped and inoculated with appropriate test organisms. Residual activity was measured by log reduction of test organism. The results are in Table 5b below:

TABLE 5b

| Test No. | Test Surface | Test Condition | Organism | Test time | Log Reduction |
|---|---|---|---|---|---|
| 1 | ceramic tile | Dry Wipe | *Staph. Aureus* | 24 hours | 3.30 |
| 2 | ceramic tile | Dry Wipe | *Staph. Aureus* | 24 hours | 3.72 |
| 3 | ceramic tile | Dry Wipe | *Staph. Aureus* | 12 Hours | 4.81 * |
| 4 | ceramic tile | Dry Wipe | *Staph. Aureus* | 12 hours | 5.87 ** |
| 5 | Stainless steel | Dry Wipe | *Staph. Aureus* | 24 hours | 1.50 |
| 6 | Formica | Dry Wipe | *Staph. Aureus* | 24 hours | 4.55 |
| 7 | Stainless steel | Dry Wipe | *Staph. Aureus* | 24 hours | >5.74 |
| 8 | Formica | Dry Wipe | *Staph. Aureus* | 24 hours | >5.75 |

* with an organic soil load (0.03% bovine serum)
** without an organic soil load

Example 6

A formulation using the ingredients of Table 6 was prepared.

TABLE 6

| Chemical Description | Wt. % | Functional Description | Predicted Function within the formulation |
|---|---|---|---|
| Deionized Water | 96.130 | | |
| EDTA tetra sodium salt (40%) | 0.400 | sequesterant | boosts cleaning by removing calcium soils and deposits |

TABLE 6-continued

| Chemical Description | Wt. % | Functional Description | Predicted Function within the formulation |
|---|---|---|---|
| Ammonyx DO 40 C10 dimethyl amine oxide | 0.750 | surfactant | emulsifies soils |
| Tergitol 15-S-7 (alcohol ethoxylate) | 0.300 | surfactant | emulsifies soils |
| Glucopon 425N (Alkyl Glucoside) | 0.563 | surfactant | emulsifies soils |
| BTC 2125 M (quaternary ammonium disinfectant) | 0.413 | disinfectant | kills microbes |
| Butyl Cellosolve (ethylene glycol mono-butyl ether) | 0.751 | Solvent | removes soiling |
| Polymer S2 | 0.225 | disinfectant enhancer | retains disinfectant on treated surfaces |
| Sodium Hydroxide (30%) | 0.218 | Alkali | pH balance |
| Fragrance IFF 4641 HBD | 0.250 | fragrance | Fragrance |

Example 6a

Using gravimetric analysis, the formulation of Example 6 was analyzed by measuring the percent removal of 25–29 milligrams of a lab generated, synthetic, greasy kitchen soil from enamel coated steel tiles with a Gardner Scrub Machine after 7 strokes. The percent removal was 92% soil removal.

Example 6b

The formulation of Example 6 was tested to measure the residual antimicrobial benefit of the formulation on surfaces treated with the formulation. After a test time, under normal room conditions, surfaces were wiped and inoculated with appropriate test organisms. Residual activity was measured by log reduction of test organism. The results are in Table 6b below:

TABLE 6b

| Test No. | Test Surface | Test Condition | Organism | Test time | Log Reduction |
|---|---|---|---|---|---|
| 1 | Glass slides | Dry Wipe | *Staph. Aureus* | 24 hours | 3.52 |

Example 7

A formulation using the ingredients of Table 7 was prepared.

TABLE 7

| Chemical Description | Wt. % | Functional Description | Predicted Function within the formulation |
|---|---|---|---|
| Deionized Water | 96.255 | | |
| EDTA tetra sodium salt (40%) | 0.400 | sequesterant | boosts cleaning by removing calcium soils and deposits |
| Ammonyx DO 40 C10 dimethyl amine oxide | 0.750 | surfactant | emulsifies soils |
| Tergitol 15-S-7 (alcohol ethoxylate) | 0.300 | surfactant | emulsifies soils |
| Glucopon 425N (Alkyl Glucoside) | 0.563 | surfactant | emulsifies soils |
| BTC 2125 M (quaternary ammonium disinfectant) | 0.413 | disinfectant | Kills microbes |

TABLE 7-continued

| Chemical Description | Wt. % | Functional Description | Predicted Function within the formulation |
|---|---|---|---|
| Butyl Cellosolve (ethylene glycol mono-butyl ether) | 0.751 | solvent | removes soiling |
| Polymer S2 | 0.050 | disinfectant enhancer | retains disinfectant on treated surfaces |
| 3-trimethoxysilyl)propyl-dimethyloctadecyl ammonium chloride | 0.050 | quaternary organosilane | Extra residual biocidal performance |
| Sodium Hydroxide (30%) | 0.218 | Alkali | pH balance |
| Fragrance IFF 4641 HBD | 0.250 | fragrance | Fragrance |

Example 7a

Using gravimetric analysis, the formulation of Example 7 was analyzed by measuring the percent removal of 25–29 milligrams of a lab generated, synthetic, greasy kitchen soil from enamel coated steel tiles with a Gardner Scrub Machine after 7 strokes. The percent removal was 91.6% soil removal.

Example 7b

The formulation of Example 7 was tested to measure the residual antimicrobial benefit of the formulation on surfaces treated with the formulation. After a test time, under normal room conditions, surfaces were wiped and inoculated with appropriate test organisms. Residual activity was measured by log reduction of test organism. The results are in Table 7b below:

TABLE 7b

| Test No. | Test Surface | Test Condition | Organism | Test time | Log Reduction |
|---|---|---|---|---|---|
| 1 | Ceramic tile | Dry Wipe | *Staph. Aureus* | 24 hours | 2.83 |
| 2 | Ceramic tile | Dry Wipe | *Staph. Aureus* | 24 hours | 4.87 |

Example 8

A formulation using the ingredients of Table 8 was prepared.

TABLE 8

| Chemical Description | Wt. % | Functional Description | Predicted Function within the formulation |
|---|---|---|---|
| Deionized Water | 76.1380 | | |
| EDTA tetra sodium salt (40%) | 14.1620 | sequesterant | boosts cleaning by removing calcium soils and deposits |
| Butyl Carbitol (di-ethylene glycol butyl ether) | 5.8410 | Solvent | removes soils |
| Tergitol NP-10 | 0.7302 | surfactant | emulsifies soils |
| BTC 2125 M (quaternary ammonium disinfectant) | 0.2633 | disinfectant | kills microbes |
| EDTA acid | 0.1809 | Acid form of sequesterant | pH adjustment |
| Polymer S2 | 0.1460 | disinfectant enhancer | retains disinfectant on treated surfaces |
| Rhodoquat RP50 (50%) (benzalkonium chloride) | 2.4900 | disinfectant | kills microbes |
| Givaudan-Roure PA 55386 | 0.0486 | fragrance | Fragrance |

Example 9

A formulation using the ingredients of Table 9 was prepared.

TABLE 9

| Chemical Description | Wt. % | Functional Description | Predicted Function within the formulation |
|---|---|---|---|
| Deionized Water | 73.25 | | |
| Butyl Carbitol (di-ethylene glycol butyl ether) | 2.00 | Solvent | removes soils |
| dipropylene glycol butyl ether | 3.00 | Solvent | removes soils |
| BTC 888 (quaternary ammonium disinfectant) | 0.27 | disinfectant | kills microbes |
| Plurafac B25-5 (alcohol ethoxylate) | 1.25 | surfactant | emulsifies soils |
| Ethomeen 0/12 (ethoxylated oleyl amine) | 1.00 | surfactant | emulsifies soils |
| Mackam 2CSF (disodium cocoamphodipropionate) | 4.95 | surfactant | emulsifies soils |
| EDTA tetra sodium salt (40%) | 12.00 | sequesterant | boosts cleaning by removing calcium soils and deposits |
| EDTA acid | 0.13 | Acid form of sequesterant | pH adjustment |
| Dequest 2016 (phosphonate) | 1.40 | Corrosion inhibitor | |
| AMP-95 (2-amino 2-methyl 1-propanol) | 0.50 | Solvent | Corrosion inhibitor |
| Polymer S2 | 0.20 | disinfectant enhancer | retains disinfectant on treated surfaces |
| Givaudan-Roure PA 55386 | 0.05 | fragrance | fragrance |

Example 9a

Using gravimetric analysis, the formulation of Example 9 was analyzed by measuring the percent removal of a lab generated, soap scum from 6 ceramic tiles with a Gardner Scrub Machine after 7 strokes. The percent removal for 3 tests was 70%, 75.6% and 89.6% soil removal.

Example 9b

The formulation of Example 9 was tested to measure the residual antimicrobial benefit of the formulation on surfaces treated with the formulation. After a test time, under normal room conditions, surfaces were wiped and inoculated with appropriate test organisms. Residual activity was measured by log reduction of test organism. The results are in Table 9b below:

TABLE 9b

| Test No. | Test Surface | Test Condition | Organism | Test time | Log Reduction |
|---|---|---|---|---|---|
| 1 | Ceramic tile | Dry Wipe | *Staph. Aureus* | 1 minute contact | 2.63 |
| 2 | Ceramic tile | Dry Wipe | *Staph. Aureus* | 10 minute contact | 4.28 |

Example 10

A formulation using the ingredients of Table 10 was prepared.

TABLE 10

| Chemical Description | Wt. % | Functional Description | Predicted Function within the formulation |
|---|---|---|---|
| Deionized Water | 73.15 | | |
| Butyl Carbitol (di-ethylene glycol butyl ether) | 2.00 | Solvent | removes soils |

TABLE 10-continued

| Chemical Description | Wt. % | Functional Description | Predicted Function within the formulation |
|---|---|---|---|
| dipropylene glycol butyl ether | 3.00 | Solvent | removes soils |
| BTC 888 (quaternary ammonium disinfectant) | 0.27 | disinfectant | kills microbes |
| Plurafac B25-5 (alcohol ethoxylate) | 1.25 | surfactant | emulsifies soils |
| Ethomeen 0/12 (ethoxy-lated oleyl amine) | 1.00 | surfactant | emulsifies soils |
| Mackam 20SF (disodium cocoamphodipropionate) | 4.95 | surfactant | emulsifies soils |
| EDTA tetra sodium salt (40%) | 12.00 | sequesterant | boosts cleaning by removing calcium soils and deposits |
| EDTA acid | 0.13 | Acid form of sequesterant | pH adjustment |
| Dequest 2016 (phosphonate) | 1.40 | Corrosion inhibitor | |
| AMP-95 (2-amino 2-methyl 1-propanol) | 0.50 | Solvent | Corrosion inhibitor |
| Polymer S2 | 0.20 | disinfectant enhancer | retains disinfectant on treated surfaces |
| 3-trimethoxysilyl)propyl-dimethyloctadecyl ammonium chloride | 0.15 | quaternary organosilane | Extra residual biocidal performance |

Example 11

The Polymer S2 was made up in isopropanol at 2% w/v and diluted 2× serially to produce a 1% w/v solution, a 0.5% solution and a 0.25% w/v solution of the Polymer S2 in isopropanol. Two microliters of these materials were spread over approximately 1 square inch of the surface of a sterile petri dish (polystyrene or glass). The polystyrene and glass surfaces were treated with the alcohol solution (0.25% w/v, 0.5% w/v, 1% w/v, 2% w/v) of the polymer S2 at a rate of 5 to 40 $\mu$g/sq. in. respectively. The plates were dried at 35° C. for 10–15 minutes to remove alcohol and leave a film of polymer. Fifteen milliliters of microbiological growth medium (tryptic soy broth) were added to each plate. Each plate was placed on a reciprocating shaker overnight at 70 rpm at ambient temperature (18–20° C.). After 18–20 hours, the medium was removed and replaced with fresh medium, and 100 microliters of a 24 hour culture of organisms *Klebsiella pneumonia* (gram negative bacteria) and *Pseudomonas fluorescens* (gram negative bacteria) was inoculated into each plate. The plates were placed on the shaker overnight at 70 rpm. After 18–24 hours, the liquid culture was decanted, and the plates were washed with 3–15 ml. aliquots of tap water. The plates were dried and imaged as is or after staining with 10% Grams crystal violet for 1 minute, rinsed and dried. Macro and micro images were then taken to determine the levels of biofilm formation in the (0.25% w/v, 0.5% w/v, 1% w/v, 2% w/v) plates. All plates showed virtually complete inhibition of *Klebsiella pneumonia* and *Pseudomonas fluorescens* biofilm formation.

The above procedure was also undertaken with a competitive product disinfectant aerosol spray having a claim of residual antimicrobial effect. Macro and micro images were also taken to determine the levels of biofilm formation in the competitive product plates. The levels of biofilm formation in the Polymer S2/isopropanol treated plates and the competitive product treated plates were then compared. The sections of the polystyrene and glass surfaces treated with an isopropanol solution (0.25% w/v, 0.5% w/v, 1% w/v, 2% w/v) of the polymer S2 at a rate of 5 to 40 $\mu$g/sq. in. showed virtually complete inhibition of *Klebsiella pneumonia* and

*Pseudomonas fluorescens* biofilm formation whereas biofilm grew in the untreated sections of the polystyrene and glass surfaces. The competitive product treated plates had biofilm growing on both the treated and the untreated sections of the plates 24 hours after treatment under the above test conditions. Thus, the Polymer S2/isopropanol solution provides residual inhibition against the growth of biofilm on the surfaces.

Therefore, there has been provided a hard surface antimicrobial cleaner which cleans and disinfects a hard surface and also provides for residual effectiveness versus bacteria. Further, there has been provided a hard surface antimicrobial cleaner which cleans and disinfects a hard surface and thereafter inhibits the formation of biofilm on the hard surface. Although the present invention has been described in detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The hard surface antimicrobial cleaner according to the invention may be used for cleaning and disinfecting a hard surface, and also provides for residual effectiveness versus bacteria on the hard surface and/or residual inhibition against the formation of biofilm on the hard surface.

We claim:

1. A hard surface antimicrobial cleaner comprising:

from about 0.01% to about 20% by weight of the total weight of the cleaner of a disinfectant;

from about 0.01% to about 20% by weight of the total weight of the cleaner of a polysiloxane with at least one poly(oxyalkylene) side chain and having the formula

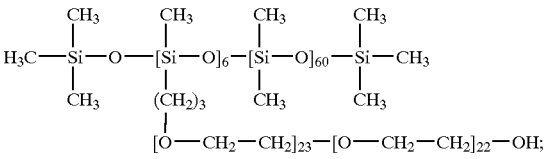

and from about 0.5% to about 20% by weight of the total weight of the cleaner of a solvent, wherein the cleaner kills bacteria on a hard surface for at least 24 hours after being sprayed onto and wiped from the hard surface.

2. The cleaner of claim 1 further comprising:

from 0.1 to about 20% by weight of the total weight of the cleaner of a sequesterant.

3. The cleaner of claim 1 further comprising:

from 0.5 to about 20% by weight of the total weight of the cleaner of a surfactant selected from nonionic surfactants, amphoteric surfactants, sarcosine anionic surfactants, cationic surfactants and mixtures thereof.

4. A hard surface antimicrobial cleaner comprising:

from about 0.01% to about 20% by weight of the total weight of the cleaner of a disinfectant;

from about 0.01% to about 20% by weight of the total weight of the cleaner of a polysiloxane with at least one poly(oxyalkylene) side chain;

from about 0.5% to about 20% by weight of the total weight of the cleaner of a solvent; and from 0.01 to about 5% by weight of the total weight of the cleaner of a water soluble organosilane of the formula: $A_{3-x}B_xSiD$ wherein A is —OH or a hydrolyzable group, B is an alkyl group of from 1 to 4 carbon atoms, x has a value of 0, 1 or 2, and D is a hydrocarbon group of from 1 to 4 carbon atoms, phenyl, or a nonionic or cationic, substituted-hydrocarbon group containing at least one oxygen or nitrogen group or salts of such substituted-hydrocarbon groups, wherein the cleaner kills bacteria on a hard surface for at least 24 hours after being sprayed onto and wiped from the hard surface.

5. A method for cleaning and disinfecting a hard surface and providing residual effectiveness against bacteria to the hard surface, the method comprising:

applying the cleaner of claim 1 to the hard surface.

6. A hard surface antimicrobial cleaner comprising:

from about 0.01% to about 20% by weight of the total weight of the cleaner of a disinfectant;

from about 0.01% to about 20% by weight of the total weight of the cleaner of a polysiloxane with at least one poly(oxyalkylene) side chain and having the formula

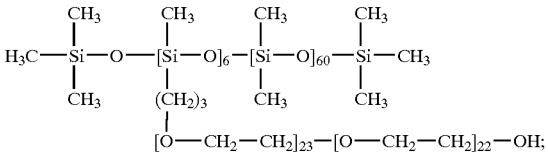

from about 0.5 to about 20% by weight of the total weight of the cleaner of a surtactant selected from nonionic surfactants, amphoteric surfactants, sarcosine anionic surfactants, cationic surfactants and mixtures thereof, wherein the cleaner kills bacteria on a hard surface for at least 24 hours after being sprayed onto and wiped from the hard surface.

7. A hard surface antimicrobial cleaner comprising:

from about 0.01% to about 20% by weight of the total weight of the cleaner of a disinfectant;

from about 0.01% to about 20% by weight of the total weight of the cleaner of a polysiloxane with at least one poly(oxyalkylene) side chain;

from 0.5 to about 20% by weight of the total weight of the cleaner of a surfactant selected from nonionic surfactants, amphoteric surfactants, sarcosine anionic surfactants, cationic surfactants and mixtures thereof; and from 0.01 to about 5% by weight of the total weight of the cleaner of a water soluble organosilane of the formula: $A_{3-x}B_xSiD$ wherein A is —OH or a hydrolyzable group, B is an alkyl group of from 1 to 4 carbon atoms, x has a value of 0, 1 or 2, and D is a hydrocarbon group of from 1 to 4 carbon atoms, phenyl, or a nonionic or cationic, substituted-hydrocarbon group containing at least one oxygen or nitrogen group or salts of such substituted-hydrocarbon groups, wherein the cleaner kills bacteria on a hard surface for at least 24 hours after being sprayed onto and wiped from the hard surface.

8. A method for cleaning and disinfecting a hard surface and providing residual effectiveness against bacteria to the hard surface, the method comprising:

applying the cleaner of claim 6 to the hard surface.

9. A hard surface antimicrobial cleaner comprising:

from about 0.01% to about 20% by weight of the total weight of the cleaner of a disinfectant;

from about 0.01% to about 20% by weight of the total weight of the cleaner of a polysiloxane with at least one poly(oxyalkylene) side chain; and a water soluble organosilane of the formula: $A_{3-x}B_xSiD$ wherein A is —OH or a hydrolyzable group, B is an alkyl group of from 1 to 4 carbon atoms, x has a value of 0, 1 or 2, and D is a hydrocarbon group of from 1 to 4 carbon atoms, phenyl, or a nonionic or cationic, substituted-hydrocarbon group containing at least one oxygen or nitrogen group or salts of such substituted-hydrocarbon groups, wherein the cleaner kills bacteria on a hard surface for at least 24 hours after being sprayed onto and wiped from the hard surface.

10. The cleaner of claim 9, wherein:

the polysiloxane has the formula: $R_1R_2R_3SiO(R_4R_5SiO)_p(R_6QSiO)_qSiR_3R_2R_1$ in which $R_1$, $R_2$, $R_4$, $R_5$, $R_6$ are identical or different and are a $C_1$–$C_6$ alkyl or phenyl, $R_3$ is identical or different and is $C_1$–$C_6$ alkyl, phenyl or Q, and Q is an ether polyoxyalkylene group of the formula —R—O—$(R'O)_nR''$ where R is a linear or branched $C_3$–$C_{15}$ alkyl group, $(R'O)_n$ is a poly (ethyleneoxy) and/or poly(propyleneoxy) group, n is a mean value ranging from 5 to 200, R" is H or a $C_1$–$C_6$ alkyl group, p is a mean value ranging from 10 to 200, and q is 0 or a mean value ranging from 1 to 200, $R_3$ being Q when q is 0.

11. The cleaner of claim 9 wherein:

the polysiloxane has the formula:

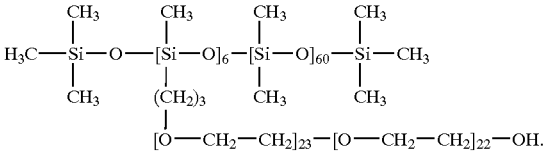

12. The cleaner of claim 9 wherein:

the water soluble organosilane is present in the cleaner in the range of from 0.01 to about 5% by weight of the total weight of the cleaner.

13. A method for cleaning and disinfecting a hard surface and providing residual effectiveness against bacteria to the hard surface, the method comprising:

applying the cleaner of claim 9 to the hard surface.

14. A hard surface antimicrobial cleaner comprising:

from about 50% to about 99.9% by weight of the total weight of the cleaner of an alkyl alcohol disinfectant; and a polysiloxane with at least one poly(oxyalkylene) side chain and having the formula

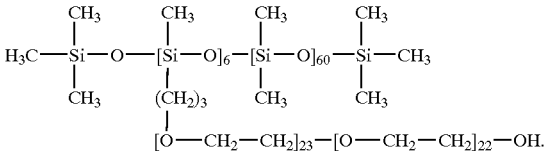

wherein the cleaner inhibits biofilm formation on a hard surface for at least 24 hours after being sprayed onto the hard surface.

15. The cleaner of claim 14 wherein:

the disinfectant is present in the cleaner in the range of about 60% to about 80% by weight of the total weight of the cleaner.

16. The cleaner of claim 14 wherein:

the polysiloxane with at least one poly(oxyalkylene) side chain is present in the cleaner in the range of from about 0.01% to about 20% by weight of the total weight of the cleaner.

17. The cleaner of claim 14 wherein:

the alkyl alcohol is ethanol, n-propanol or isopropanol.

18. The cleaner of claim 14 wherein:

the alkyl alcohol is isopropanol.

19. The cleaner of claim 14 wherein:

the alkyl alcohol is ethanol, n-propanol or isopropanol, and the disinfectant is present in the cleaner in the range of about 60% to about 80% by weight of the total weight of the cleaner.

20. The cleaner of claim 14 wherein:

the alkyl alcohol is ethanol, n-propanol or isopropanol, and the disinfectant is present in the cleaner in the range of about 60% to about 80% by weight of the total weight of the cleaner, and the polysiloxane with at least one poly(oxyalkylene) side chain is present in the cleaner in the range of from about 0.01% to about 20% by weight of the total weight of the cleaner.

21. A method for cleaning and disinfecting a hard surface and providing residual inhibition against biofllm formation on the hard surface, the method comprising:

applying to the hard surface an antimicrobial cleaner comprising:

from about 50% to about 99.9% by weight of the total weight of the cleaner of an alkyl alcohol disinfectant; and a polysiloxane with at least one poly(oxyalkylene) side chain, wherein the cleaner inhibits biofllm formation on a hard surface for at least 24 hours after being sprayed onto the hard surface.

22. The method of claim 21 wherein:

biofilm formation is inhibited for at least 24 hours.

* * * * *